United States Patent [19]

Martin

[11] Patent Number: 4,516,773

[45] Date of Patent: May 14, 1985

[54] GOLF TEES AND BALL MARKER ASSEMBLY

[76] Inventor: Clyde J. Martin, 8767 Appleknoll La., Cincinnati, Ohio 45236

[21] Appl. No.: 434,757

[22] Filed: Oct. 18, 1982

[51] Int. Cl.[3] ..... A63B 57/00

[52] U.S. Cl. ..... 273/32 A; 273/211; 366/343; D21/234

[58] Field of Search ..... 273/33, 211, 203, 32 A, 273/183 A; 366/343; D21/234

[56] References Cited

U.S. PATENT DOCUMENTS

| | | | |
|---|---|---|---|
| D. 191,326 | 9/1961 | Wheat | D7/42 |
| D. 207,412 | 3/1967 | La Barbera | D7/42 |
| D. 216,816 | 3/1970 | Bennett | D21/234 |
| 1,623,782 | 4/1927 | Dent et al. | 273/183 A X |
| 1,678,944 | 7/1928 | Jacobsen | 273/211 |
| 1,864,516 | 6/1932 | Becket | 273/33 |
| 2,455,705 | 12/1948 | Seager | 273/211 |
| 2,456,511 | 12/1948 | Isserstedt | 273/205 |
| 2,508,155 | 5/1950 | Gerlach | 273/205 |
| 2,560,414 | 7/1951 | Cheney | 273/33 |
| 2,747,768 | 5/1956 | Raines | 273/33 |
| 3,675,929 | 7/1972 | Guarino | 273/183 A |

FOREIGN PATENT DOCUMENTS

| | | | |
|---|---|---|---|
| 771536 | 11/1967 | Canada | 273/33 |
| 445026 | 4/1936 | United Kingdom | 273/211 |

*Primary Examiner*—George J. Marlo
*Attorney, Agent, or Firm*—Frost & Jacobs

[57] ABSTRACT

A swizzle stick made up of a plurality of golf tees and ball markers. The tees are connected in an end-to-end relationship with the point of one tee preferably connected to the ball support end of an adjacent tee. One or more ball markers may be attached at the ends or at locations intermediate of the tees. The ball supporting end of the tees has a flat circular surface and three similarly shaped elements projecting above the flat surface, the elements also being equally spaced about the perimeter of the surface.

3 Claims, 12 Drawing Figures

GOLF TEES AND BALL MARKER ASSEMBLY

BACKGROUND OF THE INVENTION

1. Field of the Invention

The present invention relates generally to a swizzle stick and, more particularly, to a swizzle stick comprising a series of separable elements which are useful as golf accessories.

2. Description of the Prior Art

A rod-like element used to stir mixed drinks is commonly referred to as a swizzle stick. However, the original stirring function of the swizzle stick has largely been superseded by its usefulness as an advertising tool. Advertisers and promoters have found that a swizzle stick can be effective in communicating the name of a client in association with the goods or services rendered. In view of the percentage of the adult population who consume mixed drinks, it is readily apparent that the advertisement on a swizzle stick would reach a large number of perspective customers.

To further enhance the effectiveness of a swizzle stick as an advertising tool, prior art workers have sought ways to attract attention to the swizzle stick itself. For example, an emblem or figure can be creatively applied at the top of the swizzle stick to attract the user's attention, in hopes that the advertising message on the swizzle stick will also receive some attention. From an advertising standpoint, it is particularly desirable for the consumer to be so attracted to the swizzle stick that it would be retained rather than discarded after being used to stir the drink. This purpose is frequently accomplished where the swizzle stick has certain value as a souvenir item.

It should be kept in mind, however, that a swizzle stick is primarily a disposable item. Thus, its cost of manufacture must be minimal. This consideration has generally limited the prior art workers to swizzle sticks that are relatively simplistic.

Another way to increase the overall desirability or value of a swizzle stick as an advertising tool is to relate the swizzle stick to a particular interest of the user. It has been found that a swizzle stick which is connected to the sport of golf in some way has an advantage since a large number of those who would come in contact with a swizzle stick also participate in the game of golf. Accordingly, a swizzle stick which has significant appeal to golfers certainly provides great potential as an advertising tool. In particular, a swizzle stick which would also have utility as a golf accessory would be especially desirable.

SUMMARY OF THE INVENTION

The swizzle stick of the present invention comprises a series of separable elements which are usable as golf accessories, i.e., golf ball tees and markers. Since a swizzle stick must be an elongated rod-like structure to accomplish its stirring function, the golf accessories are connected in such manner as to provide the required shape. Specifically, the golf tees are attached end-to-end and, in the preferred embodiment, the pointed end of one tee contacts the ball supporting end of the adjacent tee. In addition, a ball marker can also be made a part of the swizzle stick by connecting it to one or more of the tees, at an intermediate position or at either end, preferably so that the pointed shaft of the marker contacts the ball supporting surface of the uppermost tee.

The swizzle stick of the present invention provides an effective advertisement tool and the advertiser's message may be imprinted directly on the elongated body of the tee. If desired, a flat may be formed in the side of the tees to facilitate application of lettering. Furthermore, the head of the ball marker provides a large flat surface upon which the advertiser's message can be very effectively displayed.

To keep the cost of the swizzle stick to a minimum, a one-piece molded plastic structure is preferred. To facilitate molding of the swizzle stick, the present invention provides a unique configuration for the ball supporting end of the golf tee. The end is essentially flat rather than dish-shaped as is commonly known. The flat surface has three triangular-shaped projections which taper downwardly toward the center of the tee. These three projections provide sufficient stability for the ball when the tee is in use.

Accordingly, the swizzle stick of the present invention is a very effective advertising tool. It can be produced at low cost and is of such a nature that it will very likely be retained by the consumer after its use as a swizzle stick. Thus, the advertiser's message will remain with the consumer and quite possibly be communicated to others through the golf accessory elements.

DETAILED DESCRIPTION OF INVENTION

Figure 1:
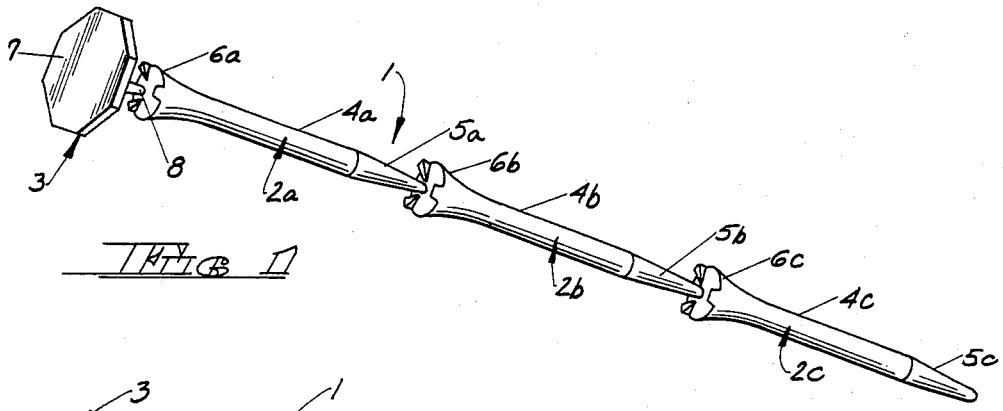
FIG. 1 is a perspective view of a swizzle stick embodying the features of the present invention.

Illustrated in FIG. 1, indicated generally at 1, is a swizzle stick made according to the present invention. The swizzle stick 1 comprises a plurality of separable, substantially identical golf tees *2a*, *2b* and *2c* in an end-to-end configuration and a ball marker 3. As used in the specification and claims, the phrase "golf tee" refers to a well-known structure used by participants in the game of golf to hold the golf ball above the ground when hitting the tee shot for each hole. Each of the tees *2a*, *2b* and *2c* has a cylindrical central portion *4a*, *4b* and *4c*, a pointed end *5a*, *5b* and *5c* to facilitate insertion in the ground, and an enlarged, ball support end *6a*, *6b* and *6c* which actually carries the golf ball. As is also well-known, a ball marker is defined as an article used in the game of golf to mark the position of the golf ball on the green when the participant finds it necessary to pick up the ball. The ball marker 3 has an enlarged, flat head 7, generally illustrated as octagonal, and a pointed shaft 8 to hold the marker 3 in position once it is placed on the green.

Figure 2:
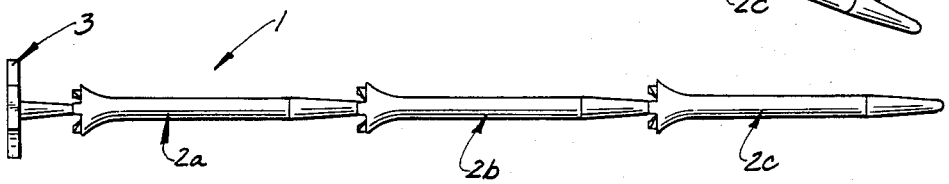
FIG. 2 is a front elevational view of the swizzle stick shown in FIG. 1.

In the preferred embodiment, illustrated in FIGS. 1 and 2, the swizzle stick 1 consists of three tees 2*a*, 2*b* and 2*c* and one ball marker 3. The pointed end 5*a* of the first tee 2*a* is connected to the ball support end 6*b* of the second tee 2*b* and the pointed end 5*b* of the second tee 2*b* is connected to the ball support end 6*c* of the third tee 2*c*. The shaft 8 of the ball marker 3 is connected to the ball support end 6*a* of the first tee 2*a*.

To minimize cost of manufacture, it is preferable that the swizzle stick 1 be molded from an economical material, such as plastic, in one-piece. The points at which the tees and marker connect are of minimal cross-section area so that they are easily separable. Alternatively, it is within the scope of the present invention to produce the tees and marker separately and connect them in such manner that they would be easily separated. However, such an alternative would significantly increase the cost of the swizzle stick 1. It should be noted that the tees and marker are connected along their centerlines to produce a straight structure, suitable for stirring drinks; this is easily observed by referring to FIGS. 2, 3 and 4.

Figure 6:
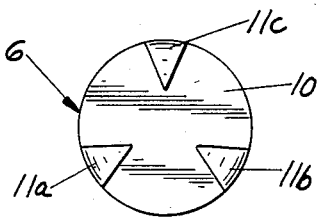
FIG. 6 is a top plan view of the ball supporting end of the tee shown in FIG. 5.
Figure 7:
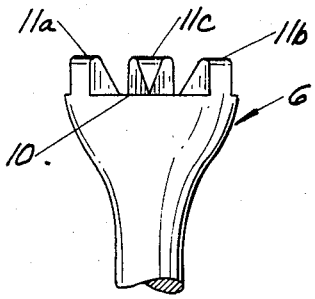
FIG. 7 is an enlarged fragmentary elevational view of the ball supporting end of the tee shown in FIG. 5.

To further minimize cost of manufacture, the present invention incorporates tees 2 in which the ball support end 6 has certain unique features. Specifically, referring to FIGS. 5, 6 and 7, the ball support end 6 has a circular, flat surface 10 and three projections 11*a*, 11*b* and 11*c* extending above the surface 10. The projections 11*a*, 11*b* and 11*c* are equally spaced along the perimeter of the surface 10, have triangular sides extending radially inwardly and a triangular top extending inwardly and downwardly. As should be apparent, the projections 11*a*, 11*b* and 11*c* actually contact and support the golf ball when the tee 2 is in use. The flat surface 10, in contrast to a conventional dish-shaped surface, allows much simplified mold construction, reducing start-up costs and subsequent production costs.

Figure 5:
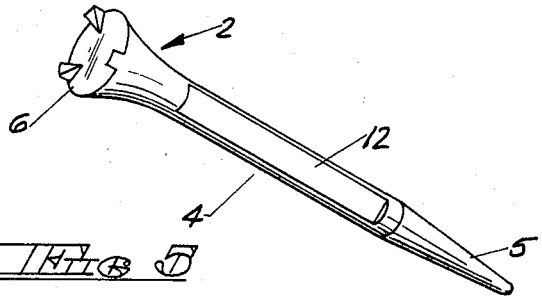
FIG. 5 is an isolated perspective view of a golf tee which may be combined with other elements to form a swizzle stick according to the present invention.

To enhance the advertising capabilities of the swizzle stick 1, one or more of the tees may be provided with an elongated flat surface 12 formed in the cylindrical portion 4 of the body of the tee 2, as shown in FIG. 5. The flat surface 12 is preferably formed during the molding of the swizzle stick 1. Printing may be easily and economically applied to the surface 12 in a number of ways well-known in the art.

Figure 3:
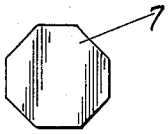
FIG. 3 is a top plan view taken from the left in FIG. 2.
Figure 4:
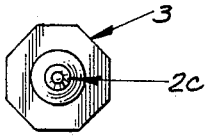
FIG. 4 is a bottom plan view taken from the right in FIG. 2.
Figure 10:
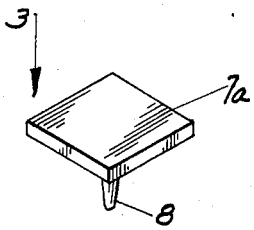
FIGS. 10–12 are perspective views of alternative shapes for a ball marker used to form an element of a swizzle stick made according to the present invention.
Figure 12:
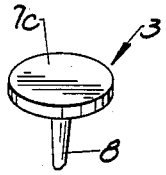
Figure 11:
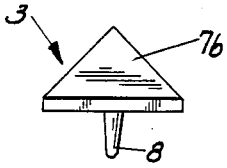

Another surface suitable for application of advertising material is the head 7 of the ball marker 3; FIG. 3 shows clearly the significant amount of surface area available. To enhance the appearance of the swizzle stick 1, the head 7 of the marker 3 may take on a variety of shapes as shown in FIGS. 10–12. In addition to the octagonal shape in the other FIGURES, FIG. 10 shows a square head 7*a*, FIG. 11 shows a triangular head 7*b*, and FIG. 12 shows a circular head 7*c*. It should be understood that in addition to the shapes specifically shown in the drawings, the head 7 of the marker 3 could have any geometrical shape. In addition, the head 7 could be a stylized company logo to further contribute to the advertising function of the present invention. Alternatively, it is contemplated that an advertiser may choose to connect some type of figure or character to the end of the swizzle stick in addition to or in lieu of the ball marker 3, to convey a particular advertising message or serve as an attention getter.

Figure 8:
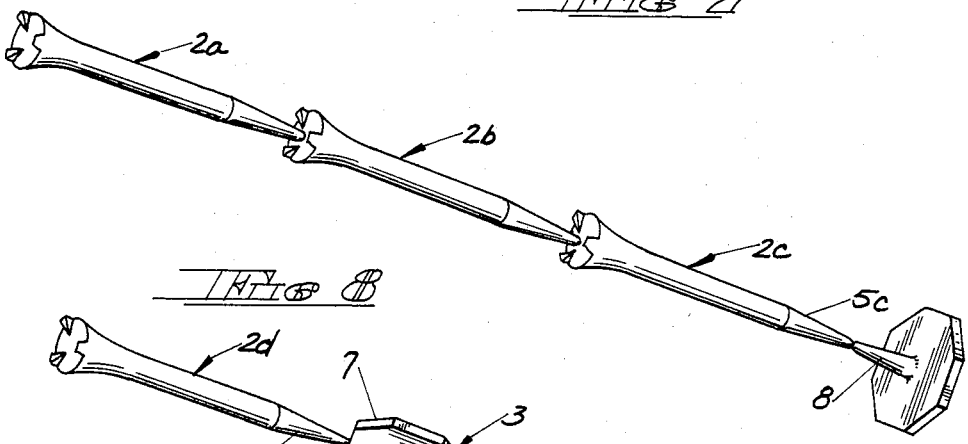
FIG. 8 is a perspective view illustrating an alternative embodiment of a swizzle stick according to the present invention.
Figure 9:
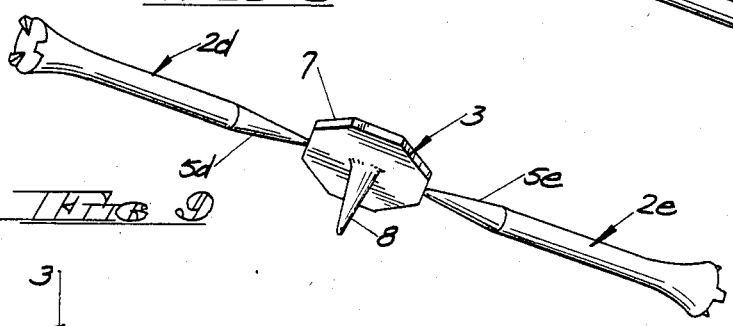
FIG. 9 is a perspective view illustrating a second alternative embodiment of a swizzle stick made according to the present invention.

Alternative embodiments of the present invention are shown in FIGS. 8 and 9. The swizzle stick shown in FIG. 8 has the same arrangement of the tees 2*a*, 2*b* and 2*c* as that shown in FIG. 1. The difference in this embodiment is that the shaft 8 of the ball marker 3 is connected to the pointed end 5*c* of the third tee 2*c*. The alternative shown in FIG. 9 incorporates the ball marker 3 at a position intermediate the tees 2*d* and 2*e*. As is clearly seen in this FIGURE, the pointed end 5*d* of a first tee 2*d* connects to the edge of the head 7 of the marker 3 and the pointed end 5*e* of a second tee 2*e* is also connected to the edge of the head 7 at a point where the centerlines of the two tees are coaxial. Although specific embodiments have been described, the present invention is not intended to be limited to the specific structures shown since other combinations using any number of tees and/or markers will be apparent to one skilled in the art.

As should now be apparent, the present invention provides a swizzle stick made up of a series of separable golf tees and golf ball markers. To facilitate manufacture of the swizzle stick, the present invention incorporates a unique structure for the ball supporting end of the tee. Variations and modifications can be made without departing from the spirit and purpose of the invention.

What is claimed is:

1. A one-piece package for golfers including at one end thereof a ball marker having a flat first end and a pointed second end, and connected to said pointed second end of said ball marker a plurality of solid golf tees, wherein each tee has a central portion, a first pointed end, and a second flat enlarged end containing at least 3 prongs by which a golf ball may be supported, said tees being separably connected in an end-to-end relationship so that said plurality of connected tees and ball marker may first be used as a swizzle stick, said tees being separable from one-another by a readily fracturable joint.

2. The structure claimed in claim 1 wherein there are three tees, the pointed end of a first tee being connected to the ball supporting end of a second tee and the pointed end of the second tee be connected to the ball supporting end of a third tee.

3. The structure claimed in claim 2 wherein said pointed second end of the ball marker is connected to the flat enlarged end of the first tee.

* * * * *